US007119605B2

(12) United States Patent
Eberlein

(10) Patent No.: US 7,119,605 B2
(45) Date of Patent: Oct. 10, 2006

(54) DYNAMIC TRANSCONDUCTANCE BOOSTING TECHNIQUE FOR CURRENT MIRRORS

(75) Inventor: Matthias Eberlein, Gilching (DE)

(73) Assignee: Dialog Semiconductor GmbH, Kirchhein/Teok-Nabein (DE)

( * ) Notice: Subject to any disclaimer, the term of this patent is extended or adjusted under 35 U.S.C. 154(b) by 127 days.

(21) Appl. No.: 10/948,007

(22) Filed: Sep. 23, 2004

(65) Prior Publication Data

US 2006/0055454 A1 Mar. 16, 2006

(30) Foreign Application Priority Data

Sep. 14, 2004 (EP) ..... 04368064

(51) Int. Cl.
*G05F 1/10* (2006.01)

(52) U.S. Cl. ..... 327/538

(58) Field of Classification Search ..... 323/315; 327/403, 404, 530, 534, 535, 537, 538, 540, 327/541, 543

See application file for complete search history.

(56) References Cited

U.S. PATENT DOCUMENTS

| | | | | |
|---|---|---|---|---|
| 4,028,631 A | | 6/1977 | Ahmed | 330/19 |
| 5,243,231 A | | 9/1993 | Baik | 307/296.3 |
| 5,510,750 A | | 4/1996 | Cho | 327/546 |
| 5,686,821 A | | 11/1997 | Brokaw | 323/273 |
| 5,793,248 A | * | 8/1998 | Lee et al. | 327/543 |
| 5,889,393 A | | 3/1999 | Wrathall | 323/282 |
| 5,892,355 A | * | 4/1999 | Pansier et al. | 323/315 |
| 6,710,583 B1 | | 3/2004 | Stanescu et al. | 323/280 |

FOREIGN PATENT DOCUMENTS

EP 419821 A 4/1991

OTHER PUBLICATIONS

Co-pending U.S. Patent App. DS-04-034, filed Sep. 23, 2004, U.S. Appl. No. 10/948,008, assigned to the same assignee as the current invention, "Adaptive Biasing Concept for Current Mode Voltage Regulators."

* cited by examiner

*Primary Examiner*—Jeffrey Zweizig
(74) *Attorney, Agent, or Firm*—Saile Ackerman LLC; Stephen B. Ackerman

(57) ABSTRACT

Circuits and methods to increase the transconductance of a current mirror in case of small input currents of the current mirror without affecting the transconductance of said current mirror in case of large input currents have been achieved. Key of the invention is a "bypass" formed by a transistor in series with a resistor, wherein the bypass is in parallel to the input transistor of the current mirror. This bypass is only relevant for very small input currents wherein the resistor can be neglected compared to the impedance of the bypass-transistor and therefore the total transconductance of the current mirror is increased in case of very small input currents. For large input currents the resistor of the bypass effectively blocks the "bypass" path. The invention solves e.g. a problem of amplifiers having any kind of dynamic biasing namely that the input impedance of current mirrors becomes too large for very small input currents.

24 Claims, 2 Drawing Sheets

DYNAMIC TRANSCONDUCTANCE BOOSTING TECHNIQUE FOR CURRENT MIRRORS

This application is related to U.S. patent application, U.S. Ser. No. 10/948,008 filed: Sep. 23, 2004 and assigned to the same assignee as the present invention.

BACKGROUND OF THE INVENTION (1) Field of the Invention

This invention relates generally to current mirrors, and more particularly to a current mirror with increased transconductance at low biasing currents.

(2) Description of the Prior Art

Amplifiers with any kind of dynamic biasing face the problem that the input impedance of current mirrors gets to large for very small biasing currents, causing stability problems due to parasitic poles, Currently low current biasing is either not possible or compromises have to be made towards accuracy or power consumption. Especially MOS current mirrors with large mirror ratios 1:N (e.g. N>1 00) suffer from large parasitic capacitance caused by the MOS gate. In case such a current mirror is used e.g. in an amplifier employing dynamic biasing, like the output stage of a "current mode LDO", as described in the U.S. patent application U.S. Ser. No. 10/948,008 filed: Sep. 23, 2004 the input impedance (1/gm) becomes extremely large for very small currents (e.g. <200 nA). This results in a low frequency pole of the (small signal) current transfer function, which can cause stability problems. Previous solutions have either avoided such low currents or large mirror ratios (both increase power consumption), or used a resistor in parallel to the mirror input. This resistor affects negatively accuracy at medium and low currents in an unpredictable way due to process variations and also increases quiescent current.

There are various patents describing the usage of current mirrors in amplifiers or LDOs.

U.S. Pat. No. 6,710,583 to Stanescu et al. describes a low dropout voltage regulator circuit with non-Miller frequency compensation. The circuit includes an input voltage terminal; an output voltage terminal; an error amplifier having a first input coupled to a reference voltage; a voltage follower coupled to an output of the error amplifier; a pass device; and a feedback network. An input terminal of the pass device is coupled to the input voltage terminal. A control terminal of the pass device is coupled to an output of the voltage follower. An output terminal of the pass device is the output voltage terminal. The feedback network includes two resistors in series between the output voltage terminal and ground. A node between the resistors is coupled to a second input of the error amplifier. A frequency compensation capacitor also is coupled between the output voltage terminal and the node. The output stage comprises a pair of NMOS transistors cascoded by another pair of NMOS transistors, driving current mirror PMOS transistors.

U.S. Pat. No. 5,889,393 to Wrathall discloses a voltage regulator and method of voltage regulation utilizing an error amplifier and a transconductance amplifier together with a voltage reference, startup circuit and output load. The use of the transconductance amplifier allows the use of an arrangement of two poles and a zero such that the composite gain roll-off has a generally constant slope. One of the poles utilized in this stability scheme is the outer pole formed by the resistive-like load and its filter capacitor. Another pole and zero are generated in the error amplifier circuit. To decouple the noisy input supply voltage, sensitive parts of the circuit are powered by the regulated output voltage. A start circuit is provided to start up the output and voltage reference when no output voltage is present. The transconductance amplifier block has special characteristics, which allow it to work to relatively high frequency, above the gain bandwidth product of the control loop. It is driven by a fully differential push-pull, class AB amplifier. The transconductance amplifier utilizes a current mirror approach to current sensing in the output device, which utilizes cascode techniques for more accurate current sensing in the current mirror.

U.S. Pat. No. 5,686,821 to Brokaw discloses a single-loop voltage regulator controller including a high-gain transconductance amplifier that accommodates common mode inputs as low as its negative supply rail. The input stage of the amplifier produces a proportional to absolute temperature (PTAT) input offset voltage. The transconductance amplifier's inverting input is connected to the circuit common, or negative supply rail, and a tap from a feedback network is connected to the amplifier's no inverting input. The feedback network provides, at this tap, a PTAT measure of the regulator's regulated output. The amplifier's output is connected to drive a no inverting driver, which, in turn, is connected to drive the control terminal of the regulator's pass transistor. A compensation capacitor connected between the amplifier's output and the regulated output terminal ensures the regulator's stability even for relatively low level load impedances The voltage regulator further comprises a bias circuit connected to provide bias current to a current mirror, and a differential to single-ended converter connected to convert an amplified differential signal from said differential pair into a single-ended signal and to modulate the bias current in response to variations in said amplified differential signal.

SUMMARY OF THE INVENTION

A principal object of the present invention is to achieve a current mirror having increased transconductance at low input currents only.

Another principal object of the present invention is to achieve a method for current mirrors having increased transconductance at low input currents only.

In accordance with the objects of this invention a circuit to increase the transconductance of a current mirror in case of small input currents of the current mirror without affecting the transconductance of said current mirror in case of large input currents has been achieved. This circuit comprises, first, a PMOS current mirror comprising an input transistor and an output transistor, wherein the sources of said both transistors are connected to VDD voltage, the drain of the output transistor is connected to the output of the current mirror, the gates of said both transistors are interconnected, and the gate and the drain of said input transistor are interconnected. Furthermore the circuit invented comprises a bypass of the input transistor of the current mirror. This bypass comprises a resistor and a PMOS transistor, wherein one terminal of said resistor is connected to VDD voltage, the other terminal of the resistor is connected to the source of said PMOS transistor, the gate of said PMOS transistor is connected to the drain of said PMOS transistor and to the drain of said input transistor of said current mirror.

In accordance with the objects of this invention another circuit to increase the transconductance of a current mirror in case of small input currents of the current mirror without affecting the transconductance of said current mirror in case of large input currents has been achieved. This circuit comprises, first, an NMOS current mirror comprising an input transistor and an output transistor, wherein the sources of said both transistors are connected to VSS voltage, the drain of the input transistor is connected to the input of the current mirror, the drain of the output transistor is connected to the output of the current mirror, the gates of said both transistors are interconnected, and the gate and the drain of said input transistor are interconnected. Furthermore this circuit comprises a bypass of said input transistor of said current mirror comprising a resistor and a NMOS transistor, wherein one terminal of said resistor is connected to VSS voltage, the other terminal of the resistor is connected to the source of said NMOS transistor, the gate of said NMOS transistor is connected to the drain of said NMOS transistor and to the drain of said input transistor of said current mirror.

In accordance with the objects of this invention a method to increase the transconductance of a current mirror in case of small input currents of the current mirror without affecting the transconductance of said current mirror in case of large input currents has been achieved. This method comprises, first, the provision of a current mirror comprising an input and an output transistor and a bypass in parallel to said input transistor. The next steps of the method are to ensure, in case of small input currents of said current mirror, that the input transconductance of the current mirror is increased by the transconductance of said bypass, and to ensure, in case of large input currents of said current mirror, that the input transconductance of the current mirror is not impacted by the bypass.

BRIEF DESCRIPTION OF THE DRAWINGS

In the accompanying drawings forming a material part of this description, there is shown.

DESCRIPTION OF THE PREFERRED EMBODIMENTS

The preferred embodiments of the present invention disclose novel circuits and methods for current mirrors having an increased transconductance with small currents without affecting the behavior for large currents.

Figure 1:
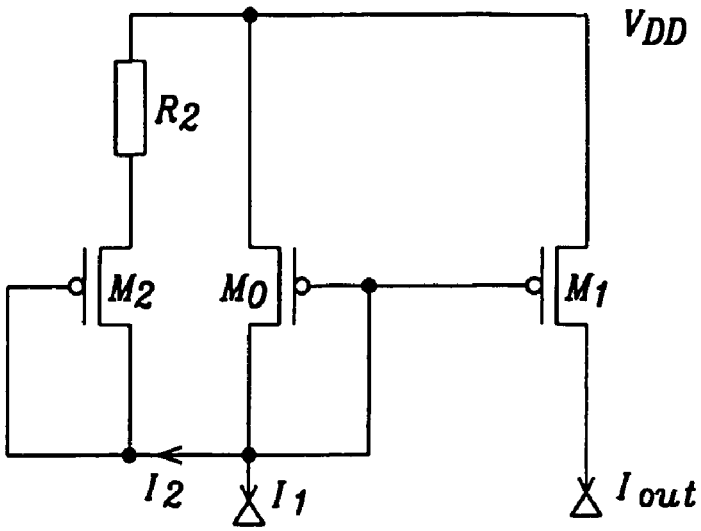
FIG. 1 shows a diagram of an embodiment of the circuit invented using PMOS transistors.

FIG. 1 shows a schematic of the circuit of the present invention comprising a current mirror 1 comprising a PMOS input transistor $M_0$ and a PMOS output transistor $M_1$. Additionally a "bypass" PMOS transistor $M_2$ is hooked up in parallel to the input transistor $M_0$ of the current mirror 1 wherein the source of $M_2$ is connected to $V_{DD}$ voltage via a resistor $R_2$, its gate is connected to its drain, to the drain of transistor $M_0$ and to the gates of transistors $M_0$ and $M_1$.

The output current $I_{OUT}$ of the current mirror is flowing through transistor $M_1$. The input current $I_1$ is flowing through transistors $M_0$ and the bypass transistor $M_2$. A "bypass" current $I_2$ is flowing through the "bypass" transistor $M_2$. Preferably transistor $M_2$ matches in regard of the channel length with transistor $M_0$ but the width of transistor $M_2$ is much larger than the width of transistor $M_0$. As a non-limiting example only, resistor $R_2$ has 50 KOhm and $$W(M_2)=6\times W(M_0),$$

wherein $W(M_2)$ is the width of transistor $M_2$ and $W(M_0)$ is the width of transistor $M_0$.

For large input currents $I_1$ resistor $R_2$ effectively blocks the "bypass" path through transistor $M_2$. Since the input impedance (1/gm0) of transistor $M_0$ is smaller than the resistance of resistor $R_2$, the "bypass" current $I_2$ or in other words the error current $I_2$ becomes negligible small.

Otherwise, in case of very small input currents $I_1$, resistor $R_2$ becomes negligible small compared to the impedance (1/gm2) of transistor $M_2$. Therefore the total input transconductance gm of the current mirror of the present invention is effectively increased to:

$$gm=gm_0+gm_2, \tag{1}$$

wherein gm0 is the transconductance of transistor $M_0$ and gm2 is the transconductance of transistor $M_2$. This results in an improved frequency transfer function. The parasitic pole can be calculated by $$f=\frac{gm}{2\cdot\pi\cdot C_1}$$

wherein $gm=gm_0+gm_2$, according to equation (1), and $C_1$ is the parasitic capacitance of the current mirror gates. The transconductance of the output transistor $M_1$ is not relevant for the transconductance of the current mirror.

Key of the invention is the "bypass" formed by transistor $M_2$ in series with resistor $R_2$. This bypass is only relevant for very small input currents wherein resistor $R_2$ can be neglected compared to the impedance of transistor $M_2$ and therefore the total transconductance of the current mirror is increased in case of very small input currents.

Figure 2:
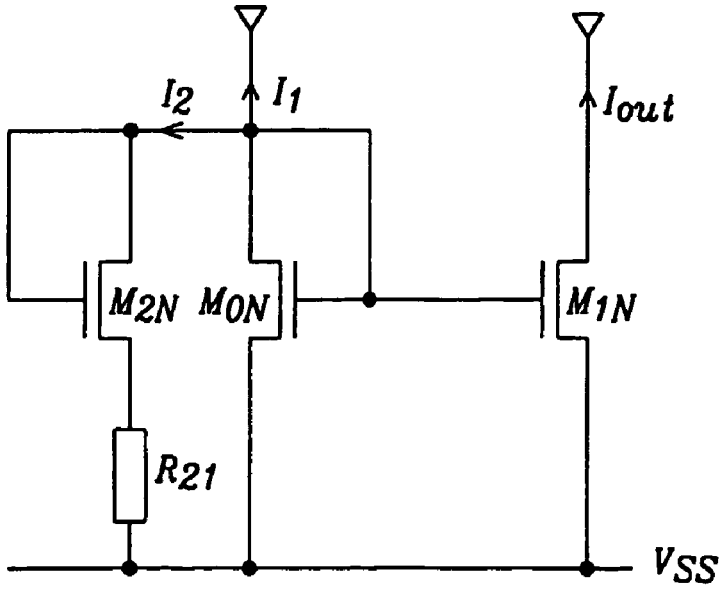
FIG. 2 illustrates a diagram of an embodiment of the circuit invented using NMOS transistors.

FIG. 2 shows an embodiment of the present invention using NMOS Transistors instead of PMOS transistors as shown in FIG. 1. The same principles as outlined above with PMOS transistors can be applied equivalently using NMOS transistors. Using NMOS transistors the sources of transistors $M_{0N}$, $M_{1N}$ and $M_{2N}$ are connected to $V_{SS}$ voltage. The source of transistor $M_{2N}$ is connected via resistor $R_2$ to $V_{SS}$ voltage, the sources of transistors $M_{0N}$ and $M_{1N}$ are directly connected to $V_{SS}$ voltage.

In both PMOS and NMOS embodiments of the present invention the "bypass" current is exactly predictable if the transconductance of the bypass transistor $M_2$ or $M_{2N}$ matches the transconductance of the input transistor $M_0$ or respectively $M_{0N}$ of the current mirror. The circuit invented improves the small signal behavior significantly without degrading large signal performance.

Additionally pnp or npn bipolar transistors can be used for an implementation of the present invention. The same principles as outlined above can be applied for bipolar transistors as well.

Figure 3:
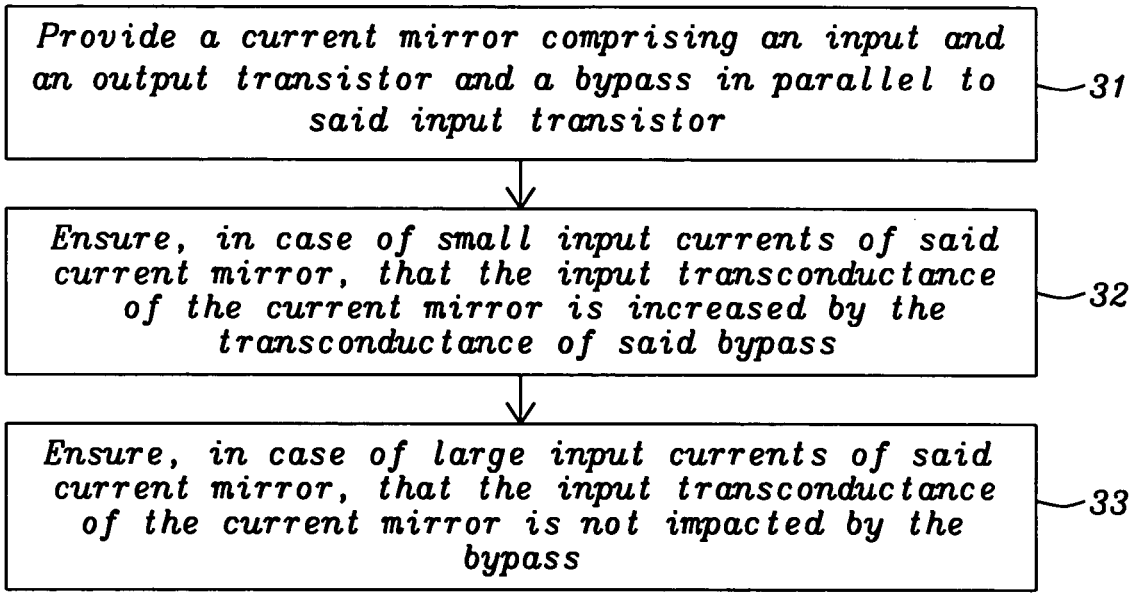
FIG. 3 shows a flowchart of the method invented to increase the transconductance of a current mirror in case of small input currents.

The flowchart of FIG. 3 illustrates a method to increase the transconductance of a current mirror in case of small input currents of the current mirror without affecting the transconductance in case of large input currents. The first step 31 describes the provision of a current mirror comprising an input and an output transistor and a bypass in parallel to said input transistor as described above. The second step 32 shows that it has to be ensured that, in case of small input currents of said current mirror, the input transconductance of the current mirror is increased by the transconductance of said bypass The next step 33 illustrates that it has to be ensured that, in case of large input currents of said current mirror, the input transconductance of the current mirror is not impacted by the bypass.

In a preferred embodiment of the invented method said bypass comprises a transistor, having a larger size than the input transistor of the current mirror, and a resistor as it has been described above. For small input currents of the current mirror this resistor becomes negligible compared to the input impedance of the transistor implemented in the bypass. For large input currents this resistor blocks the path through the bypass.

The circuits and methods invented can be e.g. applied with amplifiers having any kind of dynamic biasing. In prior art they have faced the problem of a too large input impedance of current mirrors in case of very small input currents. The invention provides a very effective solution to this problem.

While the invention has been particularly shown and described with reference to the preferred embodiments thereof, it will be understood by those skilled in the art that various changes in form and details may be made without departing from the spirit and scope of the invention.

What is claimed is:

1. A circuit to increase the transconductance of a current mirror in case of small input currents of the current mirror without affecting the transconductance of said current mirror in case of large input currents is comprising:

a PMOS current mirror comprising an input transistor and an output transistor, wherein the sources of said both transistors are connected to VDD voltage, the drain of the input transistor is connected to the input of the current mirror, the drain of the output transistor is connected to the output of the current mirror, the gates of said both transistors are interconnected, and the gate and the drain of said input transistor are interconnected; and a bypass of said input transistor of said current mirror comprising a resistor and a PMOS transistor, wherein one terminal of said resistor is connected to VDD voltage, the other terminal of the resistor is connected to the source of said PMOS transistor, the gate of said PMOS transistor is connected to the drain of said PMOS transistor and to the drain of said input transistor of said current mirror.

2. The circuit of claim 1 wherein the size of said PMOS transistor of said bypass is much larger than the size of said input transistor of said current mirror.

3. The circuit of claim 2 wherein the width of said PMOS transistor of said bypass is six-times larger that the width of said input transistor of said current mirror.

4. The circuit of claim 1 wherein said resistor has a resistance in the order of magnitude of 50 KOhm.

5. The circuit of claim 1 wherein the transconductance of said bypass transistor matches the transconductance of said input transistor of said current mirror.

6. A circuit to increase the transconductance of a current mirror in case of small input currents of the current mirror without affecting the transconductance of said current mirror in case of large input currents is comprising:

an NMOS current mirror comprising an input transistor and an output transistor, wherein the sources of said both transistors are connected to VSS voltage, the drain of the input transistor is connected to the input of the current mirror, the drain of the output transistor is connected to the output of the current mirror, the gates of said both transistors are interconnected, and the gate and the drain of said input transistor are interconnected; and a bypass of said input transistor of said current mirror comprising a resistor and a NMOS transistor, wherein one terminal of said resistor is connected to VSS voltage, the other terminal of the resistor is connected to the source of said NMOS transistor, the gate of said NMOS transistor is connected to the drain of said NMOS transistor and to the drain of said input transistor of said current mirror.

7. The circuit of claim 6 wherein the size of said NMOS transistor of said bypass is much larger than the size of said input transistor of said current mirror.

8. The circuit of claim 7 wherein the width of said NMOS transistor of said bypass is six-times larger that the width of said input transistor of said current mirror.

9. The circuit of claim 6 wherein said resistor has a resistance in the order of magnitude of 50 KOhm.

10. The circuit of claim 6 wherein the transconductance of said bypass transistor matches the transconductance of said input transistor of said current mirror.

11. A method to increase the transconductance of a current mirror in case of small input currents of the current mirror without affecting the transconductance of said current mirror in case of large input currents is comprising:

provide a current mirror comprising an input and an output transistor and a bypass in parallel to said input transistor;

ensure, in case of small input currents of said current mirror, that the input transconductance of the current mirror is increased by the transconductance of said bypass; and ensure, in case of large input currents of said current mirror, that the input transconductance of the current mirror is not impacted by the bypass.

12. The method of claim 11 wherein said bypass comprises a transistor in series with a resistor.

13. The method of claim 12 wherein said transistor of said bypass and the transistors of said current mirror are PMOS transistors.

14. The method of claim 13 wherein said PMOS transistor of said bypass is significantly larger than said input transistor of said current mirror.

15. The method of claim 13 wherein the transconductance of said PMOS transistor of said bypass matches the transconductance of said input transistor of said current mirror.

16. The method of claim 13 wherein said transistor of said bypass and the transistors of said current mirror are NMOS transistors.

17. The method of claim 16 wherein said NMOS transistor of said bypass is significantly larger than said input transistor of said current mirror.

18. The method of claim 16 wherein the transconductance of said NMOS transistor of said bypass matches the transconductance of said input transistor of said current mirror.

19. The method of claim 13 wherein said transistor of said bypass and the transistors of said current mirror are pnp bipolar transistors.

20. The method of claim 19 wherein said pnp bipolar transistor of said bypass is significantly larger than said input transistor of said current mirror.

21. The method of claim 19 wherein the transconductance of said pnp bipolar transistor of said bypass matches the transconductance of said input transistor of said current mirror.

22. The method of claim 13 wherein said transistor of said bypass and the transistors of said current mirror are npn bipolar transistors.

23. The method of claim 22 wherein said npn bipolar transistor of said bypass is significantly larger than said input transistor of said current mirror.

24. The method of claim 23 wherein the transconductance of said NMOS transistor of said bypass matches the transconductance of said input transistor of said current mirror.

* * * * *

UNITED STATES PATENT AND TRADEMARK OFFICE

CERTIFICATE OF CORRECTION

PATENT NO. : 7,119,605 B2
APPLICATION NO. : 10/948007
DATED : October 10, 2006
INVENTOR(S) : Matthias Eberlein It is certified that error appears in the above-identified patent and that said Letters Patent is hereby corrected as shown below:

On Title Page
In the Assignee, item (73), delete Assignee's address, "Kirchhein/Teok-Nabein (DE)" and replace with -- Kirchheim/Teck-Nabern (DE) --.

Signed and Sealed this

Thirtieth Day of January, 2007

JON W. DUDAS
*Director of the United States Patent and Trademark Office*